US011162214B2

(12) United States Patent
Wendeler-Göggelmann

(10) Patent No.: US 11,162,214 B2
(45) Date of Patent: Nov. 2, 2021

(54) LONGITUDINAL ELEMENT, IN PARTICULAR FOR A TRACTION OR SUSPENSION MEANS

(71) Applicant: FATZER AG DRAHTSEILFABRIK, Romanshorn (CH)

(72) Inventor: Corinna Wendeler-Göggelmann, Herisau (CH)

(73) Assignee: FATZER AG DRAHTSEILFABRIK, Romanshorn (CH)

( * ) Notice: Subject to any disclaimer, the term of this patent is extended or adjusted under 35 U.S.C. 154(b) by 0 days.

(21) Appl. No.: 16/480,389

(22) PCT Filed: Jan. 26, 2018

(86) PCT No.: PCT/EP2018/051940
§ 371 (c)(1),
(2) Date: Jul. 24, 2019

(87) PCT Pub. No.: WO2018/138250
PCT Pub. Date: Aug. 2, 2018

(65) Prior Publication Data

US 2020/0199814 A1 Jun. 25, 2020

(30) Foreign Application Priority Data

Jan. 27, 2017 (DE) ..... 10 2017 101 646.5

(51) Int. Cl.
*D07B 1/02* (2006.01)
*D07B 1/06* (2006.01)
(Continued)

(52) U.S. Cl.
CPC ..... *D07B 1/02* (2013.01); *D07B 1/025* (2013.01); *D07B 1/06* (2013.01); *D07B 1/145* (2013.01);
(Continued)

(58) Field of Classification Search
CPC . D07B 1/02; D07B 1/025; D07B 1/06; D07B 1/145; D07B 2201/2046;
(Continued)

(56) References Cited

U.S. PATENT DOCUMENTS 1,959,526 A * 5/1934 Del Mar ..... H01B 13/00 57/7
2,458,243 A * 1/1949 Biddle ..... D02G 3/185 57/229
(Continued)

FOREIGN PATENT DOCUMENTS

CN 201793989 U 4/2011
DE 3813338 A1 11/1989
(Continued)

OTHER PUBLICATIONS

Search report for DE 10 2017 101 646.5 dated Oct. 13, 2017.

*Primary Examiner* — Shaun R Hurley
(74) *Attorney, Agent, or Firm* — Brian Roffe

(57) ABSTRACT

A longitudinal element produced with a core made of high-strength fibers and at least one metal casing, preferably steel, surrounding this core. In this way, there is the significant advantage that these high-strength fibers, which are very lightweight in relation to their strength, are protected in a number of ways, namely against humidity, moisture, UV light and other environmental influences. In addition, the metal casing provides the fibers with protection against transverse loads. In this way, all the high-strength properties of the traction or suspension means are maintained over a sustained period.

21 Claims, 5 Drawing Sheets

(51) Int. Cl.
*D07B 1/14* (2006.01)
*E01F 7/04* (2006.01)

(52) U.S. Cl.
CPC ..... *D07B 2201/209* (2013.01); *D07B 2201/2046* (2013.01); *D07B 2205/2014* (2013.01); *D07B 2205/3007* (2013.01); *E01F 7/045* (2013.01)

(58) Field of Classification Search
CPC ..... D07B 2201/209; D07B 2205/2014; D07B 2205/3007; E01F 7/045
See application file for complete search history.

(56) References Cited

U.S. PATENT DOCUMENTS 2,852,423 A * 9/1958 Bassett, Jr. ..... C09J 7/28 428/189
3,824,777 A 7/1974 Riggs
4,150,249 A * 4/1979 Pedersen ..... H01B 3/441 174/36
4,349,694 A * 9/1982 Vives ..... H01B 11/1808 174/128.1
4,372,792 A * 2/1983 Dey ..... G02B 6/4483 156/172
4,577,925 A * 3/1986 Winter ..... G02B 6/4488 228/148
4,741,470 A * 5/1988 Winter ..... G02B 6/4488 228/148
4,760,362 A * 7/1988 Maki ..... H01P 11/005 156/53
5,036,166 A * 7/1991 Monopoli ..... H01B 5/12 174/128.1
5,111,646 A * 5/1992 Lange ..... H01B 13/0841 242/441.2
5,247,599 A * 9/1993 Vyas ..... G02B 6/4415 385/109
5,263,239 A * 11/1993 Ziemek ..... G02B 6/4427 156/244.12
5,595,057 A 1/1997 Yoshinori
6,164,053 A * 12/2000 O'Donnell ..... B66B 7/06 187/251
6,279,858 B1 8/2001 Eicher
6,385,957 B2 5/2002 Misrachi
6,438,824 B1 8/2002 Uhlenhuth et al.
6,674,945 B1 * 1/2004 Rowland ..... G02B 6/4422 385/101
7,069,714 B2 * 7/2006 De Boni ..... D02G 3/12 57/210
7,108,233 B2 * 9/2006 Giuseppin ..... B21F 15/04 140/88
7,629,535 B2 * 12/2009 Espen ..... H01B 7/14 174/102 R
8,176,718 B2 5/2012 Ridge et al.
8,418,433 B2 * 4/2013 Noguchi ..... B66B 7/06 57/237
8,656,686 B2 2/2014 Bruch et al.
2005/0279074 A1 * 12/2005 Johnson ..... H01B 13/0235 57/212
2010/0038112 A1 * 2/2010 Grether ..... H01B 13/02 174/128.1
2010/0101833 A1 * 4/2010 Zachariades ..... D07B 1/147 174/136
2011/0197564 A1 * 8/2011 Zachariades ..... B32B 27/12 57/210
2014/0318100 A1 10/2014 Wen
2015/0128792 A1 * 5/2015 Zachariades ..... D07B 1/04 87/6

FOREIGN PATENT DOCUMENTS

DE 19546773 A1 8/1996
DE 69517070 T2 2/2001
DE 102009034514 A1 2/2011
DE 102009040964 A1 3/2011
DE 102014105753 A1 10/2014
DE 202016106092 U1 12/2016
DE 102015015157 A1 4/2017
EP 0199348 B1 1/1991
EP 0731209 A1 7/1999
EP 0990744 A1 4/2000
GB 2187217 A 9/1987
JP H10140490 A 5/1998
WO 2009090299 A1 7/2009
WO 2013065074 A1 5/2013
WO 2014061061 A1 4/2014
WO 2018138250 A1 8/2018

* cited by examiner

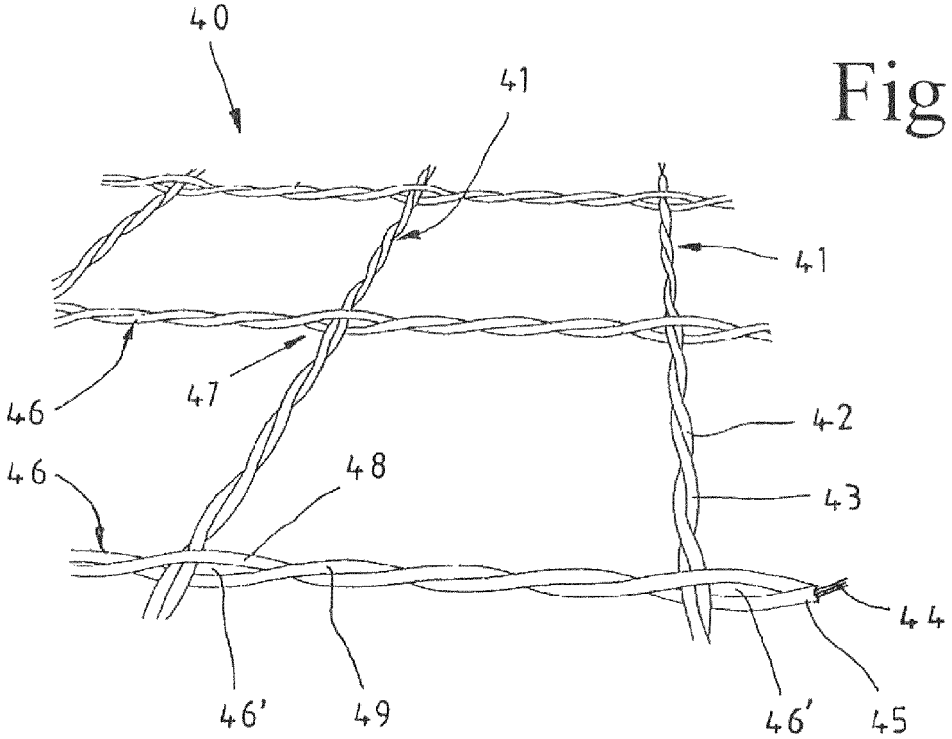
Fig. 11
Fig. 12
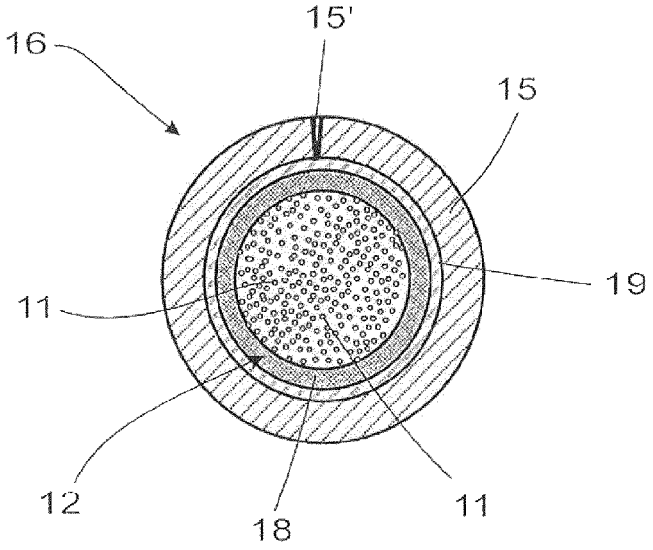

LONGITUDINAL ELEMENT, IN PARTICULAR FOR A TRACTION OR SUSPENSION MEANS

FIELD OF THE INVENTION

The invention relates to a longitudinal element, in particular for a traction or suspension means, which is produced with a core with high-strength fibers and a casing surrounding this core.

BACKGROUND OF THE INVENTION

A combined line-shaped traction and/or suspension means as in citation EP-A-2 165 017 discloses a core line of high-strength plastic fibers which is made from a twisted monofilament bundle or a plurality of drilled monofilament bundles and made with an outer layer of steel wire strands. The monofilament bundle is stretched while reducing the diameter and held in this condition by a, particularly woven, casing. This reduces the core line stretching under load so that the load distribution between the steel cross-section and plastic cross-section of the line is improved.

And conversely in the same sense, to approach the stretch behavior of the strand layer compared with that of the core line, the line has an intermediate layer of an elastic plastic into which the steel wire strands are impressed spaced separately from one another so that the outer layer stretches under load and contracts radially.

Making such a combined line is relatively expensive; nor is it protected sufficiently against the prevailing environmental influences in operation such as humidity, moisture etc.

Nets known as annular nets or meshes stand out for being highly tear-resistant and deformable and can therefore be stressed to a considerable extent. According to citation EP-B-0 979 329, such a protective net is known as a high-strength wire mesh preferably for rockfall protection or to secure a surface layer of earth which is woven from coil-shaped bent high-strength steel wires and has a three-dimensional structure. The coil-shaped bent wires have a helix angle and length between two bends which govern the shape and size of the slots in the wire mesh.

OBJECTS AND SUMMARY OF THE INVENTION

The present invention on the other hand was based on the problem of creating a longitudinal element in particular for traction or suspension means for different applications such that this shows similar characteristics to a longitudinal element made of wires which optimizes the weight whereby it should work perfectly well even under harsh environmental conditions.

According to the invention, this problem is solved by a longitudinal element that includes a core consisting of a single group of high-strength fibers, a protective or load-bypassing filling layer around only the core such that the filling layer surrounds only the single group of high-strength fibers of the core, and a metal casing surrounding only the filling layer such that the metal casing surrounds only the single group of high-strength fibers of the core.

Instead of from wires, the longitudinal elements made with a core of a plurality of high-strength fibers are each made of at least one metal casing surrounding this core, preferably steel.

Advantageously, the metal casing of the longitudinal element concerned is attached to the outside circumference of the core in such a way as to form a gas-tight, UV-tight, light- and/or water-impermeable layer for these fibers.

This has the considerable advantage that these high-strength fibers which are very light in relation to their strength are protected in many respects, particularly against humidity, moisture, UV light and other environmental influences and also by being bound to the metal casing stretch to approximately the same extent. The metal casing also protects the fibers against transverse loads: so the high-strength characteristics of the traction or suspension means remain sustainably as a whole.

One of the significant advantages of this embodiment of the wire-shaped longitudinal elements is that it is suited to a plurality of applications.

They may be used as longitudinal elements in nets, meshes, gratings or similar for protection, safety, aquaculture or architectural purposes, for example.

These longitudinal elements are just as suited to traction or suspension means such as spiral or stranded wires, prestressed lines or the like, particularly in funicular lines and transport. These longitudinal elements may be used with both running and standing line constructions.

On the other hand, these longitudinal elements may also be used in electrical cables, telecoms cables or lines, ensuring they will operate permanently perfectly even under harsh environmental conditions.

Other applications of such wire-shaped longitudinal elements are also possible within the scope of the invention which require high tensile forces and/or a high degree of environmental resistance at low weight, advantageously while having a bending effect at the same time. These longitudinal elements may also be used lying parallel to one another, i.e. not braided.

BRIEF DESCRIPTION OF THE DRAWINGS

Embodiments and other advantages within the scope of the invention will be explained more particularly with the aid of a drawing below. These show as follows:

FIG. 11 is a part view of a mesh made of longitudinal elements as in the invention, and FIG. 12 is a cross-section of a variant of a longitudinal element as in the invention.

DETAILED DESCRIPTION OF THE INVENTION

Figure 1:
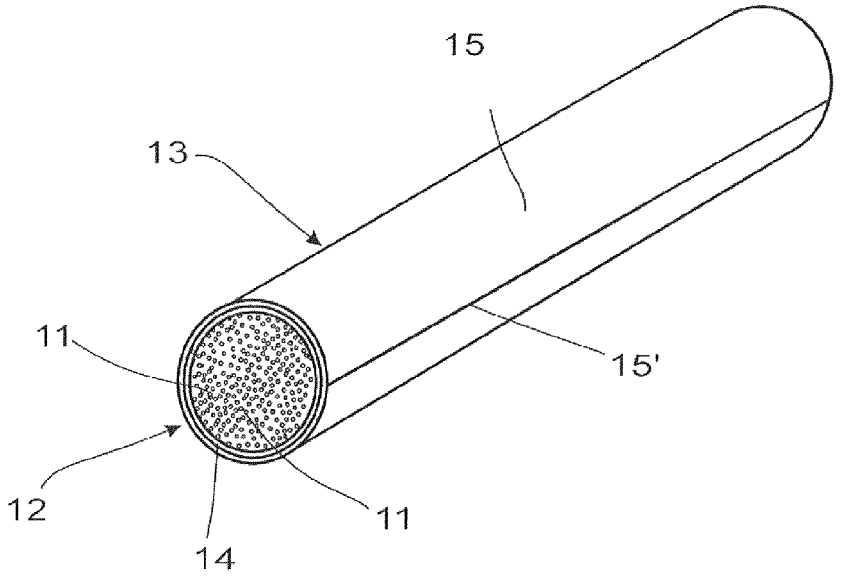
FIG. 1 is a perspective part view of a longitudinal section with cross-section.

FIG. 1 shows a longitudinal element 13 which can in particular absorb tensile forces and/or loads even at very high forces. It may be used in a wide range of applications, as the embodiments below will show.

According to the invention, this longitudinal element 13 made as a wire comprises a core 12 of a plurality of high-strength fibers 11 and a metal casing 15 surrounding this core 12 preferably made of steel and/or stainless steel.

Metal casing 15 is arranged around core 12 formed of fibers 11 and along the longitudinal extent of longitudinal element 13 and held for example by a welded seam 15' at the butted surfaces of the side edges.

Welding metal casing 15 in this way gives a gas- and watertight coating for these fibers 11, sealing them away from UV light and the atmosphere, extending their working life while maintaining almost the same strength practically without ageing them. This may be increased even more if the metal casing is made of stainless steel.

Metal casing 15 is given a certain bending and/or buckling strength to achieve a suitable flexibility and/or sufficient shock- and/or pressure resistance of the longitudinal element.

The metal casing may be given a variable casing cross-section along its longitudinal extent; likewise different kinds of high-strength fibers 11 may be used to obtain an optimum design to meet the different requirements of the specific applications concerned.

The metal casing may consist of a second and/or more casing layers. To achieve the variable cross-section, at least a second casing layer may be applied to a first casing layer including for specific distances.

A further characteristic of the invention is that metal casing 15 is made with a cylindrical outer surface. This outer surface may be shaped differently as required, of course.

Advantageously, a filling layer 14 may be inserted between metal casing 15 and core 12 of the wire-like element concerned, such as a gel or adhesive, for example, a bandaging or a mixture thereof. Depending on the application, a different degree of hardness of the filler layer may be used to obtain different transverse loads and tensile characteristics of the longitudinal element. This may be used to design the degree of attachment created in the finished longitudinal element differently depending on the application to optimize its transverse load strength.

The metal casing and/or core may be given a surface roughness to give a better connection between fibers 11 and the inside of metal casing 15 by friction and/or adhesion to give a nearly even tension/extension behavior.

The metal casing could also preferably be made as a tube into which the fibers could be inserted.

The metal casing could equally well be made by winding at least one metal strip around the core which could be joined at the overlapping and/or abutting side edges by welding, gluing or a similar connection or even without any such. A suitable material for the metal casing would be a corrosion-resistant material such as a galvanized steel but also aluminium or copper with non-corroding characteristics.

The high-strength fibers may be made of plastic fibers, for example, such as aramid (Twaron 2200) and/or carbon fibers such as carbon fibers or basalt fibers which have a tensile strength of over 2,000 N/mm$^2$. Other materials with similar characteristics could of course be used, such as HMPE and/or high-modulus polyethylene fibers (Dyneema) or similar. So-called basalt fibers and/or fibers of a mixture of plastic and basalt or another mineral additive could be used. The fibers may be arranged parallel to one another or twisted.

At least a part of the high-strength fibers could also be made of steel fibers (steel cords) which preferably have very small diameters such as 0.4 mm and a tensile strength preferably over 2,500 N/mm$^2$; but materials other than fibers are also possible which have tensile strengths over 2,000 N/mm$^2$.

Core 12 made of high-strength fibers, steel cords and/or other materials is dimensioned with an outer diameter preferably from 1.5 to 8 mm, equivalent more or less to the diameter of an ordinary wire. The wall thickness of the metal casing is preferably between 0.1 and 1.0 mm, whereby for this a steel of over 800 N/mm$^2$ and advantageously a high-strength steel with a strength of over 1,000 N/mm$^2$ is used. The metal casing, when having a wall thickness of 0.1 to 1.0 mm, can be designed as a pipe, which as known to those skilled in the art to which the invention pertains, is considered a tube of metal, plastic, or other material used to convey water, gas, oil, or other fluid substances.

Figure 2:
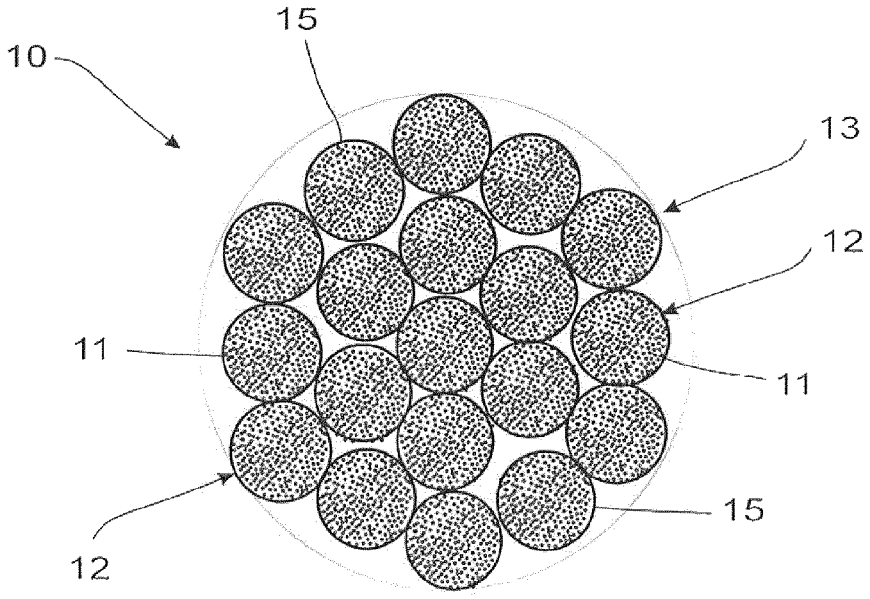
FIG. 2 is a cross-section of a traction and/or suspension means made as a spiral line with braided longitudinal elements as in FIG. 1.

FIG. 2 shows a spiral line 10 which is composed of conventionally lined longitudinal elements 13. Such a spiral line 10 is suited above all as a stop, signal or tension relief line which is used for example to stop, destress and/or to transmit energy and/or data. It may also be used as a carrying line or as a line for funicular railway cabins running on it, however.

It could also advantageously be used as a pre-stressed strand in particular for static constructions such as a roof structure in which longitudinal elements 13 are laid next to one another without being stranded or would only be wound slightly.

According to the invention, longitudinal elements 13 made as wire are made in each case of a core 12 of a plurality of high-strength fibers 11 and of at least one metal, preferably steel, casing surrounding this core 12.

Figure 3:
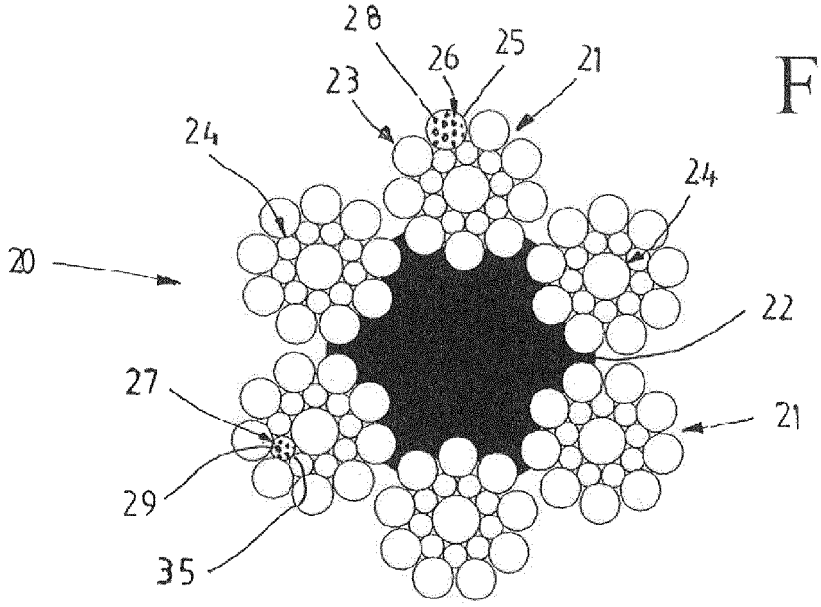
FIG. 3 is a cross-section of a traction and/or suspension means made as a braided line as in the invention.

FIG. 3 shows a braided line 20 as a traction or suspension means comprising multiple strands 21 wound around a plastic core 22.

According to the invention, individual strands 21 are made by winding wire-like longitudinal elements 23, 24 each of which is made of a core 26, 27 of a plurality of high-strength fibers 28, 29 and of at least one metal casing 25, 35, preferably steel, surrounding this core 26, 27.

Otherwise, these longitudinal elements 23, 24 are made in the same way as those in FIG. 1 and/or FIG. 2 and will therefore not be dealt with in any further detail.

Advantageously, all longitudinal elements 23, 24 of a braid 21 are made as in the invention; but individual longitudinal elements such as the innermost may also be made of a steel wire.

Figure 4:
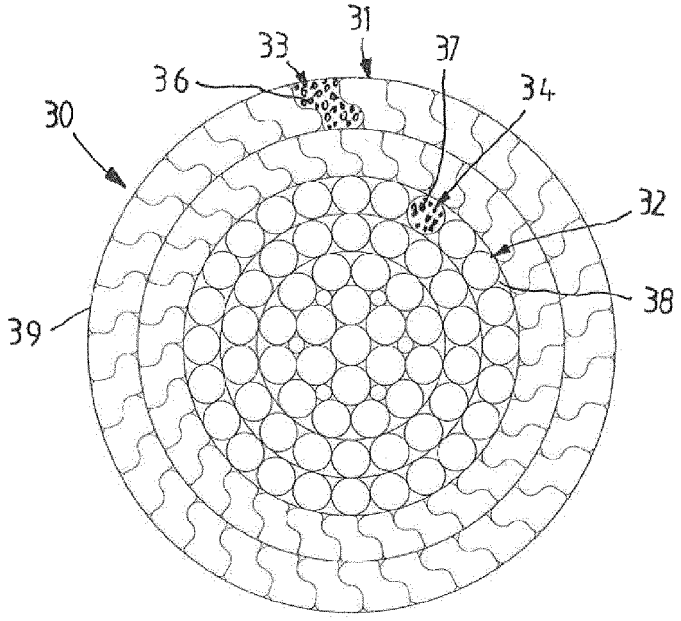
FIG. 4 is a cross-section of a traction and/or suspension means made as a sealed line as in the invention.

FIG. 4 shows a sealed spiral line 30 as a traction or suspension means in which longitudinal elements 31 at the outer circumference or in other additional layers are provided by a known means with a Z-shaped [cross-section] while inner longitudinal elements 32 have a round cross-section.

According to the invention, these Z-shaped longitudinal elements and inner ones 31, 32 as well are made in each case of a core 33, 34 of a plurality of fibers 36, 37 and of at least one metal, preferably steel, casing 38, 39 enclosing this core 12, wherein these fibers 36, 37 are shown only for one longitudinal element but all are advantageously made in this way.

As a particular feature of the invention, these Z-shaped longitudinal elements 31 are each made with an appropriately shaped metal casing 39 in which this approximately Z-shaped core 33 with fibers 36 is contained. Instead of these Z shapes, I, wedge- or other shaped longitudinal elements may be used.

The metal casing is made advantageously of or coated with a corrosion-resistant material such as stainless steel. It may also be made of two or more layers, however.

The outer circumference of the steel casing could be made with appropriate openings for wires and/or strands or the like.

Also, continuous or multiple braces laid one after another or similar could be arranged within the metal casing which would increase its rigidity. The surface of the individual longitudinal elements could be optimized in terms of surface design and/or roughness to interact with one another.

The surface of the cores of high-strength fibers should be made such that the core makes an optimum connection with the casing in terms of modulus of E and strength but no excessive loads arise in the fibers in contact with the casing.

Figure 5:
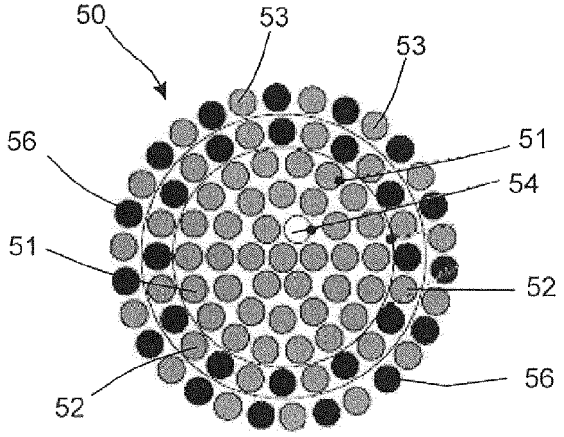
FIG. 5 is a cross-section of a telecoms line with wire-shaped longitudinal elements as in the invention.

FIG. 5 shows a diagram of a cross-section of a telecoms line 50 which is made in a per se conventional way from conductors 51, 52, 53 in multiple layers by braiding. Individual conductors 51, 52, 53 may be made of individual wires or wire strands surrounded by an insulating casing in each case. At least one conductor 54 is also integrated with the inner layer of line 50 which is provided for communication purposes or similar.

According to the invention, a number of wire-shaped longitudinal elements 56 are integrated in line 50 which consist in each case of these high-strength fibers and this surrounding metal casing which is not shown in more detail. The two outer layers here are alternately a conductor 52, 53 and neighboring longitudinal element 56. The distribution of the conductors and/or longitudinal elements could also be selected differently, of course, depending on how strong line 50 must be.

Figure 6:
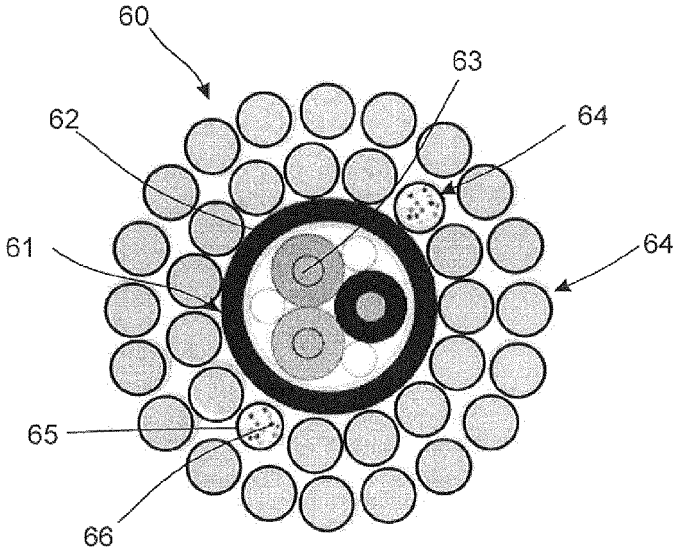
FIG. 6 is a cross-section of an electrical cable with wire-shaped longitudinal elements as in the invention.

FIG. 6 shows a cross-section of an electrical cable 60 as in the invention in diagram form the inside of which comprises a conventional single- or plural conductor 61 with casing 62 and copper conductors 63 with insulation. This conductor 61 is shrouded by two layers of longitudinal elements 64 with high-strength fibers 66 and metal casing 65 surrounding them.

Figure 7:
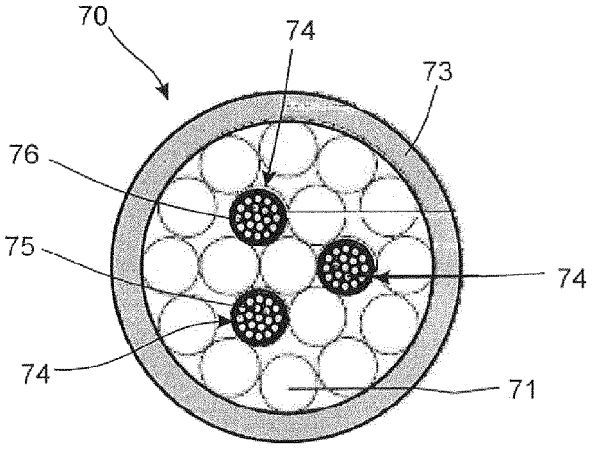
FIG. 7 is a cross-section of another variant of an electrical cable with integrated wire-shaped longitudinal elements.

FIG. 7 shows a further variant of an electrical cable 70 in cross-section, comprising a casing 73, a number of insulated copper conductors 71 or the like and longitudinal elements 74 integrated therewith. The latter, i.e., each of the longitudinal elements 74, include high-strength fibers 75 and a casing 76 surrounding these fibers that are appropriately of the same outer diameter as copper conductors 71 so these, i.e., the longitudinal elements 74 and the conductors 71, may be braided together. Three longitudinal elements 74 are arranged woven around the central copper conductor 71 and three between these copper conductors 71 arranged in each case. With this electrical cable 70 also, differences may be provided in the number and arrangement of these longitudinal elements 74.

Of course, still other variants of telecoms or electrical cables could also be shown with longitudinal section as in the invention which could be designed other than those explained above depending on the requirements or application concerned. In theory, the longitudinal elements could also be made with a casing of one or more plastic layers.

Figure 8:
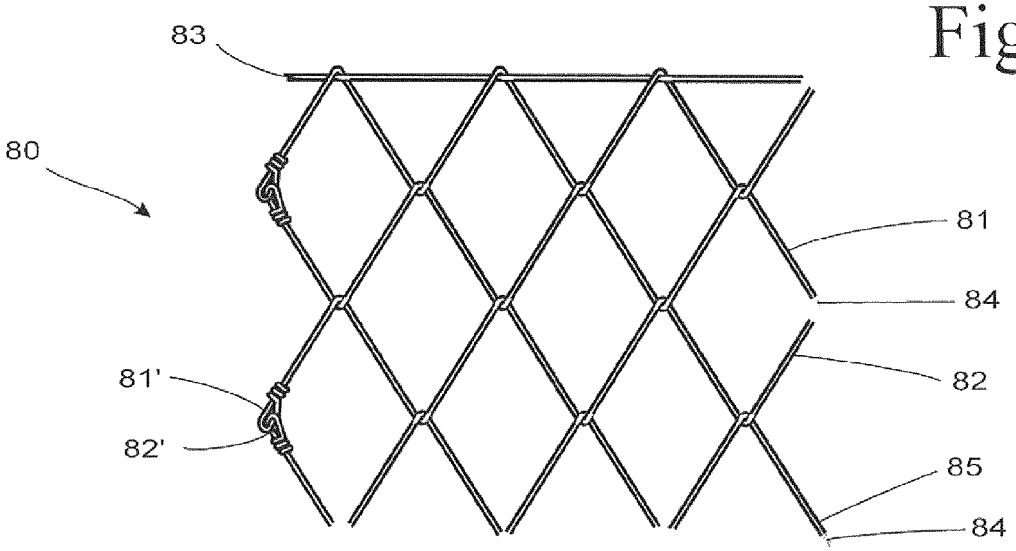
FIG. 8 is a partial view of a net shown as a mesh woven as twisted longitudinal elements as in the invention.

FIG. 8 shows how the invention is used on a known net 80 made of helical bent longitudinal elements 81, 82 which in turn are made of high-strength fibers 84 and the metal casing 85 as shown. On the end sides, these twisted pair longitudinal elements 81, 82 are engaged with a line 83 or connected jointedly likewise with one another with these end connections being represented by 81', 82'. At least two such longitudinal elements 81, 82 could also be provided as strands.

Preferably the hardness when using longitudinal elements 81, 82 selected with a filling layer such that the degree of attachment in the finished longitudinal element has a high lateral pressure strength so these helical-shaped longitudinal elements 81, 82 remain resistant to bending even under load.

As such nets and/or meshes are generally installed in mountainous areas where access is difficult, their weight savings offer considerable advantages when transporting and installing them.

Figure 9:
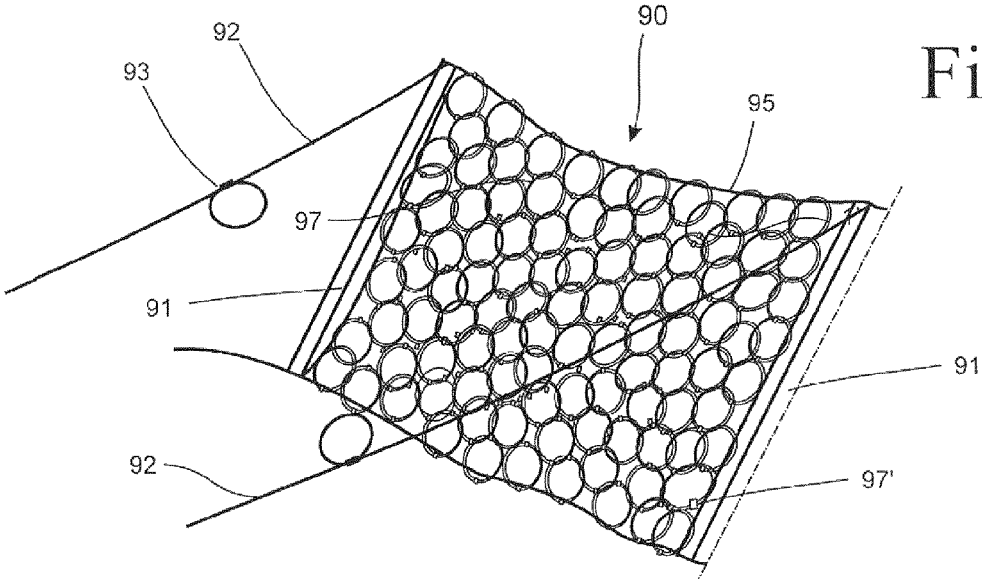
FIG. 9 is a partial view of a safety net for the protected area made of interlocking annular longitudinal elements.

FIG. 9 shows a diagram of a catchment net 90 which is installed on a mountain face for example and which can be used to catch falling stones, scree, wood or similar and/or avalanches.

This catchment net 90 is made of interlocking rings 97 in a manner which is known in itself and held via carrying and/or retaining lines 92, 95 and supports 91 anchored to the ground. The retaining lines 92 are preferably fitted with known braking elements 93 which absorb additional energy in an impact.

Interlocking rings 97 of catchment net 90 are each made of at least one wound wire-shaped longitudinal element 98 and are bound advantageously by clamps 97' or the like gripping the respective rings.

Figure 10:
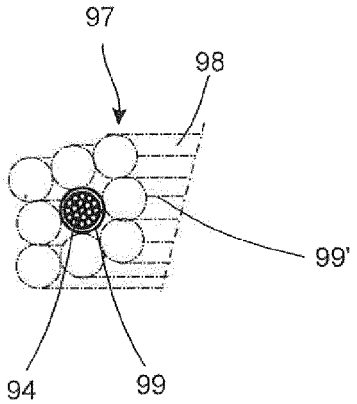
FIG. 10 is a cross-section of a ring in the net made of a longitudinal element as in FIG. 9.

According to the invention, these wound longitudinal elements 98 are each made of a core of high-strength fibers 94 and a metal casing 99 surrounding these as FIG. 10 shows.

This metal casing 99 is sealed by a welded seam 99' continuously along longitudinal element 98. Preferably these welded seams 99' are arranged in the wound state of longitudinal element 98 on the inside of the ring 97 so they are under compression when fitted. Longitudinal elements 98 may also be welded together at their ends or provided with locks. Likewise, the metal casing could also be preformed as a tube into a ring in each case and the fibers introduced into this tube.

Such longitudinal elements as in the invention could also be used in retaining lines 92 and braking elements 93 made by known means.

FIG. 11 shows part of a mesh 40 which is composed of strands 41, 46 arranged axially and laterally at certain distances to one another, the latter being made of wound longitudinal elements 42, 43 in each case. This creates openings 46' in the case of the one strand 46 at crossing points 47 between two longitudinal elements 48, 49 corresponding to the mesh length through which strands 41 arranged at an angle thereto are run, binding them together.

According to the invention, these longitudinal elements 42, 43 wound to form strands each comprise a core of high-strength fibers 44 and a metal casing 45 around them.

Such ring nets, meshes or other types of net and/or mesh each made with these longitudinal elements as in the invention are particularly suited to securing slopes for protection, safety, aquaculture or architecture or similar. They can be used either to save weight and hence reduce transport costs and make them easier to install or to make nets and meshes stronger and more usable.

FIG. 12 shows a further embodiment of a longitudinal element 16 which is designed similarly to that shown in FIG. 1 and to which the differences below have been made.

According to the invention, this longitudinal element 16 comprises a core 12 of a plurality of high-strength fibers 11, a filling layer 18 surrounding them, a composite layer 19 and a metal casing 15' surrounding the latter. Metal casing 15 is provided along its longitudinal extent with welded seam 15' for example.

This filling layer 18 surrounding fibers 11 consists preferably of a plastic, such as polyurethane which may be used as a foam or cast resin. Composite layer 19 which is an adhesive ensures that a more or less flush joint is made between core 12 and filling layer 18 and metal casing 15 and so creates a load-distributing force distribution of the tensile stress and/or load-bearing capacity on the core and the metal casing of longitudinal element 16.

It is therefore advantageous if materials can be used for this filling layer 18 and/or composite layer 19 which are flexible, pressure stable and low shrinkage, depending on the application concerned so they meet operating requirements. Such suitable materials are plastics, advantageously polyurethane or arathane, although other substances may also be used. If these longitudinal elements are exposed to highly fluctuating temperatures when installed, the materials must also be heat- and cold-resistant.

A further requirement of this filling layer 18 and/or composite layer 19 is that these as protection must have thermal insulation characteristics so the high-strength fibers 11 are not weakened by being overheated or even lose their tensile strength when metal casing 15 made as a tube is welded.

In the course of the invention, such a longitudinal element 16 is made in such a way that the fibers 11 are first laid against one another and/or bundled and are surrounded by filling layer 18. The latter may be pressed on or applied as resin and attached thereto. Metal casing 15 is cut to length from a longitudinal plate or similar and composite layer 19 and filling layer 18 as the case may be applied to its inside. It is then bent around fibers 11 without any play between them and then made by fixing welded seam 15' at its ends to longitudinal element 16. It must be verified that the metal casing is gas- and water-impermeable once made so the longitudinal elements remain permanently weatherproof.

Instead of this filling and composite layer, only one or the other could be used of course or more than just one layer in each case could be provided if certain characteristics of the longitudinal element are to be achieved. A thin separate layer of a thermal insulation material of plastic could be embedded, for example.

It would also be possible that the filling and/or composite layer could be extended into the core between the fibers so the core holds together better.

The invention is shown sufficiently with the embodiments explained above; but it could also be illustrated by other variants.

The metal casing could also be glued at an overlap and/or at the face of the projecting end of the casing.

To detect damage- or fatigue-induced changes in the composite, an optical or electrical measuring element may also be inserted in the core or between the metal casing and the core to enable damage to be detected by magnetic induction. On the other hand, magnetisable casing materials could be used to use contemporary measurement methods (e.g. MRT) to detect damage.

The invention claimed is:

1. A method for making a longitudinal element, comprising:

providing high-strength fibers alongside one another to form a single cylindrical core of high-strength fibers having an outer diameter of 1.5 mm to 8 mm;

providing a protective or load-bypassing filling layer, bandage or mixture thereof;

providing a metal plate; and bending the metal plate around the single cylindrical core of high-strength fibers while the filling layer, bandage or mixture thereof is interposed between the metal plate and the single cylindrical core of high-strength fibers and then connecting abutting longitudinal edges of the metal plate to one another to form a metal casing around the filling layer, bandage or mixture thereof which in turn is around the single cylindrical core of high-strength fibers.

2. The method according to claim 1, further comprising providing a composite layer, the step of bending the metal plate around the single cylindrical core of high-strength fibers comprising bending the metal plate while the filling layer, bandage or mixture thereof is interposed between the composite layer and the single cylindrical core of high-strength fibers and the composite layer is interposed between the filling layer, bandage or mixture thereof and the metal casing to thereby form a three-layered structure around the single cylindrical core of high-strength fibers with the filling layer, bandage or mixture thereof being an innermost layer closest to the single cylindrical core of high-strength fibers, the composite layer being around the filling layer, bandage or mixture thereof and an intermediate layer and the metal casing being around the composite layer and an outermost layer.

3. The method according to claim 1, further comprising attaching the metal casing to the filling layer, bandage or mixture thereof such that a layer that is impermeable by gas, UV radiation and/or water is formed for the high-strength fibers of the single cylindrical core.

4. The method according to claim 1, wherein the high-strength fibers of the single cylindrical core each extend through the longitudinal element in its entirety in one piece, and are straight or stranded.

5. The method according to claim 1, wherein the high-strength fibers of the single cylindrical core comprise at least one of plastic, basalt, and carbon.

6. The method according to claim 1, wherein the metal casing has a wall having a thickness of 0.1 mm to 1.0 mm.

7. The method according to claim 1, wherein the metal casing has a cylindrical outer surface.

8. The method according to claim 1, further comprising providing an optical or electrical measuring element in the single cylindrical core or between the metal casing and the single cylindrical core, to recognize changes caused by damage and/or fatigue.

9. The method according to claim 1, further comprising closing ends of the longitudinal element.

10. The method according to claim 1, wherein the longitudinal element has a round-shaped, Z-shaped, I-shaped, or wedge-shaped cross-section.

11. The method according to claim 1, wherein at least one of an inside of the metal casing and the single cylindrical core is surface-roughened.

12. The method according to claim 1, wherein the step of providing the high-strength fibers alongside one another to form the single cylindrical core of high-strength fibers comprises bundling the high-strength fibers into a single bundle.

13. The method according to claim 1, wherein the step of providing the filling layer, bandage or mixture thereof around the single cylindrical core comprises pressing the filling layer, bandage or mixture thereof onto the single cylindrical core of high-strength fibers.

14. The method according to claim 1, further comprising providing a composite layer around the filling layer, bandage or mixture thereof, the step of bending the metal plate around the single cylindrical core of high-strength fibers comprising bending the metal plate around the composite layer which in turn is around the filling layer, bandage or mixture thereof which in turn is around the single cylindrical core of high-strength fibers.

15. The method according to claim 1, wherein the step of providing the filling layer, bandage or mixture thereof around the single cylindrical core of high-strength fibers comprises applying the filling layer, bandage or mixture thereof as a resin attached to the single cylindrical core of high-strength fibers.

16. The method according to claim 1, wherein the step of providing the filling layer, bandage or mixture thereof around the single cylindrical core of high-strength fibers comprises applying the filling layer, bandage or mixture thereof to an inside of the metal plate before bending the metal plate around the single cylindrical core of high-strength fibers.

17. The method according to claim 1, wherein the step of connecting abutting longitudinal edges of the metal plate to one another to form a metal casing comprises welding the abutting longitudinal edges to one another to form a welded seam in a longitudinal direction.

18. The method according to claim 1, wherein the step of bending the metal plate around the single cylindrical core of high-strength fibers comprises bending the metal plate while only the filling layer, bandage or mixture thereof is interposed between the metal casing and the single cylindrical core of high-strength fibers to thereby form a two-layered structure around the single cylindrical core of high-strength fibers with the filling layer, bandage or mixture thereof being an innermost layer closest to the single cylindrical core of high-strength fibers, and the metal casing being around the filling layer, bandage or mixture thereof and an outermost layer.

19. The method according to claim 1, further comprising extending the filling layer, bandage or mixture thereof into the single cylindrical core of high-strength fibers between the high-strength fibers.

20. The method according to claim 1, wherein the step of bending the metal plate around the single cylindrical core of high-strength fibers comprises bending the metal plate around the single cylindrical core of high-strength fibers to eliminate play between the high-strength fibers.

21. A method for making a longitudinal element, comprising:

providing high-strength fibers alongside one another to form a single cylindrical core of high-strength fibers, the high-strength fibers of the single cylindrical core comprising steel fibers each having a tensile strength of more than 2,500 $N/mm^2$;

providing a protective or load-bypassing filling layer, bandage or mixture thereof;

providing a metal plate; and bending the metal plate around the single cylindrical core of high-strength fibers while the filling layer, bandage or mixture thereof is interposed between the metal plate and the single cylindrical core of high-strength fibers and then connecting abutting longitudinal edges of the metal plate to one another to form a metal casing around the filling layer, bandage or mixture thereof which in turn is around the single cylindrical core of high-strength fibers.

* * * * *